US007081911B2

(12) United States Patent
Sawai

(10) Patent No.: US 7,081,911 B2
(45) Date of Patent: Jul. 25, 2006

(54) THERMAL-TRANSFER PRINTER

(75) Inventor: Kunio Sawai, Daito (JP)

(73) Assignee: Funai Electric Co., Ltd., Daito (JP)

( * ) Notice: Subject to any disclaimer, the term of this patent is extended or adjusted under 35 U.S.C. 154(b) by 62 days.

(21) Appl. No.: 10/900,391

(22) Filed: Jul. 28, 2004

(65) Prior Publication Data

US 2005/0062834 A1 Mar. 24, 2005

(30) Foreign Application Priority Data

Jul. 28, 2003 (JP) ..... 2003-202294

(51) Int. Cl.
*B41J 2/335* (2006.01)

(52) U.S. Cl. ..... 347/197

(58) Field of Classification Search ..... 347/197, 347/198, 222; 346/145; 400/120.16
See application file for complete search history.

(56) References Cited

U.S. PATENT DOCUMENTS 4,962,392 A * 10/1990 Okuno et al. ..... 346/145
5,541,635 A * 7/1996 Wills et al. ..... 347/197
5,694,159 A * 12/1997 Kajiya et al. ..... 347/197
5,779,371 A * 7/1998 Aoyama et al. ..... 400/120.16
6,061,076 A * 5/2000 Ishii et al. ..... 347/197

FOREIGN PATENT DOCUMENTS

| | | |
|---|---|---|
| JP | 5-085012 | 4/1993 |
| JP | 11-058878 | 3/1999 |
| JP | 2001-353923 | 12/2001 |

* cited by examiner

*Primary Examiner*—K. Feggins
(74) *Attorney, Agent, or Firm*—Crowell & Moring LLP

(57) ABSTRACT

The thermal-transfer printer includes: a main body frame 10; a platen roller 20; a thermal head 31; a pair of head supporting arms 33 (head attaching arms 32); and a pressing member 40 for pivoting the head supporting arms 33 (head attaching arms 32) to a side of the platen roller 20. The pressing member 40 includes a first pressing arm 41 and a second pressing arm 42, and a connecting member 43 having two of a first bending portion 43*a* and a second bending portion 43*b* in an L-lettered shape. The first pressing arm 41 includes: a recess portion 41*a*; a supporting shaft portion 41*b*; a first notch portion 41*c*; and a drawout preventing portion 41*d*. The second pressing arm 42 includes: a recess portion 42*a*; a supporting shaft portion 42*c*; and a second notch portion 42*d*.

6 Claims, 12 Drawing Sheets

THERMAL-TRANSFER PRINTER

BACKGROUND OF THE INVENTION

1. Field of the Invention

The present invention relates to a thermal-transfer printer, particularly relates to a thermal-transfer printer having a thermal head.

2. Description of the Related Art

In a conventional art, there is known a structure for supporting a thermal head having a head supporting member for pivoting the thermal head to a side of a platen roller and a thermal printer (thermal-transfer printer) mounted with the supporting structure.

In JP-A-11-058878, there is disclosed a structure of supporting a thermal head having a head pressing spring plate, a thermal head attached to the head pressing spring plate via a head supporting plate, and a head pressing shaft for pivoting the thermal head to a side of a platen roller. According to the structure of supporting a thermal head disclosed in JP-A-11-058878, the head pressing spring plate includes a middle back plate having a tongue piece having spring performance at a center thereof and portions which are liable to bend provided on both sides thereof, and arm portions provided at both end portions of the middle back plate. The arm portion is pivotably supported by a supporting shaft of a frame. Further, the head pressing shaft is configured to pivot the thermal head to the side of the platen roller by pressing the tongue piece of the head pressing spring plate. Further, in JP-A-11-058878, there is not disclosed a mechanism for moving the head pressing shaft to press the head pressing spring plate.

Further, JP-A-5-085012 discloses a thermal head pressing apparatus of a thermal printer configured to arrange a torsion bar having bending portions at both ends thereof at a supporting portion provided at an upper portion of the thermal head and exert a pressing force to the bending portions. In the structure of supporting the thermal head disclosed in JP-A-5-085012, mentioned above, there is configured to pivot the thermal head provided at a front end portion of a leaf spring member to a side of a platen roller while always balancing left and right pressing forces and generating printing pressure to the thermal head. However, JP-A-5-085012 does not disclose a mechanism of pivoting the leaf spring attached with the thermal head to the side of the platen roller.

Further, JP-A-2001-353923 discloses a thermal printer according to an example of a conventional art having a pair of first link members one end of each of which is pivotably supported by a base portion of an apparatus, at other end of each of which, a vicinity of heat generating portion of the thermal head is supported, and a pair of second link members one end of each of which is supported by the base portion and at other end of each of which, the thermal head is supported. According to the thermal printer disclosed in JP-A-2001-353923, mentioned above, the first link member supporting the thermal head is configured to be made to move between an operating position and an escaping position by transmitting a torque of a worm gear fixed to an output shaft of a motor to a worm wheel provided at a surrounding of a pivoting shaft member of the first link member.

FIG. 12 is a top view showing a thermal-transfer printer according to other example of a conventional art. FIG. 13 is a side sectional view of the thermal-transfer printer according to other example of the conventional art shown in FIG. 12. FIG. 14 is a perspective view showing a heating portion and a pressing member of the thermal-transfer printer according to other example of the conventional art shown in FIG. 12. FIG. 15 is a disassembled perspective view of the heating portion and the pressing member of the thermal-transfer printer according to other example of the conventional art shown in FIG. 14. FIG. 16 through FIG. 20 are perspective views for explaining details of the pressing member and a connecting member of the thermal-transfer printer according to other example of the conventional art shown in FIG. 12. First, an explanation will be given of a structure of a thermal-transfer printer 100 according to other example of the conventional art.

As shown by FIG. 12 and FIG. 13, the thermal-transfer printer 100 according to other example of the conventional art includes a main body frame 110, a platen roller 120, a heating portion 130, a pressing member 140, a power transmitting portion 150, an ink cartridge 160, a first carrying roller 170 and a second carrying roller 180. Further, the power transmitting portion 150 includes a motor 151, two middle gears 152, and a drive gear 153. The motor 151 transmits a drive force to the drive gear 153 via the two middle gears 152.

The main body frame 110 is provided with two supporting shafts 111 for pivotably supporting two side faces of the heating portion 130 opposed to each other. A torsional coil spring 111*a* is mounted to one side of the two supporting shafts 111. The torsional coil spring 111*a* is mounted to urge to pivot the heating portion 130 in an arrow mark E direction of FIG. 13. Further, as shown by FIG. 13, the heating portion 130 is configured to be pivotable in the arrow mark E direction or an arrow mark F direction of FIG. 13 and pressed to the platen roller 120 by a predetermined pressing force. As shown by FIG. 13 through FIG. 15, the heating portion 130 includes a thermal head 131, a pair of head attaching arms 132, a pair of head supporting arms 133, two compression coil springs 134, a heat radiating member 135.

The thermal head 131 is provided with a function of generating heat to predetermined temperature. Further, as shown by FIG. 15, two spring attaching boss portions 131*a* are provided at an upper face of the thermal head 131. Further, the pair of head attaching arms 132 include arm a pressing portions 132*a*, fitting hole portions 132*b*, and head attaching portions 132*c*. The arm pressing portion supporting arm 133 urged to pivot in the arrow mark E direction of FIG. 13 relative to the thermal head 131. The fitting hole portion 130*b* is fit to the supporting shaft 111 of the main body frame 110. Further, the head attaching portion 130*c* is attached with the thermal head 131.

Further, the pair of head supporting arms 133 are provided to pinch the pair of head attaching arms 132 attached with the thermal head 131 from outer sides. The head supporting arm 133 includes a boss portion 133*a*, a fitting hole portion 133*b*, and a spring pressing portion 133*c*. The boss portion 133*a* is provided to project to an outer side at a side face of a vicinity of one end portion of the head supporting arms 133. Further, the fitting hole portion 133*b* is provided at a vicinity of other end portion of the head supporting arm. The fitting hole portion 133*b* is fit with the supporting shaft 111 of the main body frame 110. Further, the spring pressing portion 133*c* is provided to project from an upper portion of the head supporting arm 133 to an inner side.

Further, the two compression coil springs 134 are respectively fit between the two spring attaching boss portions 131*a* of the thermal head 131 and the spring pressing portions 133*c* of the pair of head supporting arms 133. Thereby, the thermal head 131 is brought into a state of being supported by the head supporting arm 133 via the compression coil spring 134. Further, the heat radiating member 135 is arranged above an upper face of the thermal head 131 and is provided with a function of radiating heat of the thermal head 131.

Further, as shown by FIG. 12 through FIG. 15, the pressing member 140 is configured to be able to move the thermal head 131 to a side of the platen roller 120 by pressing the boss portion 133*a* of the pair of head supporting arms 133 and transmitting the pressing force to the thermal head 131 via the compression coil springs 134. The pressing member 140 includes a first pressing arm 141, a second pressing arm 142, and a connecting member 143. As shown by FIG. 16 and FIG. 17, the first pressing arm 141 includes a fitting portion 141*a* in an oval shape. As shown by FIG. 12 and FIG. 17, the fitting portion 141*a* of the first pressing arm 141 is fit with an oval shape portion 143*a* of the connecting member 143 from a side opposed to a side for providing the power transmitting portion 150. Further, as shown by FIG. 18, the second pressing arm 142 includes a fitting portion 142*a* in an oval shape and a gear engaging portion 142*b*. As shown by FIG. 12 and FIG. 20, the fitting portion 142*a* of the second pressing arm 142 is fit with an oval shape portion 143*c* (refer to FIG. 19) of the connecting member 143 on a side provided with the power transmitting portion 150. Further, the gear engaging portion 140*b* of the second pressing arm 142 is arranged to engage with the drive gear 113 of the power transmitting portion 150.

Further, as shown by FIG. 14 and FIG. 15, the connecting member 143 is formed by a rod-like member. The connecting member 143 is connected with the first pressing arm 141 and the second pressing arm 142. Further, the connecting member 143 is provided with a function of transmitting a drive force provided from the drive gear 153 engaged with the gear engaging portion 142*b* of the second pressing arm 142 to the first pressing arm 141. As shown by FIG. 19, the connecting member 143 includes a groove portion 143*b* and the oval shape portion 143*c* in addition to the above-described oval shape portions 143*a*. The oval shape portions 143*a* and 143*c* are provided on both sides of the connecting member 143 and formed by cutting. Further, as shown by FIG. 12 and FIG. 14, the groove portion 143*b* is fit with an E ring 144.

FIG. 21 and FIG. 22 are side sectional views for explaining operation of the thermal-transfer printer according to other example of the conventional art. Next, an explanation will be given of operation of the thermal-transfer printer 100 according to other example of the conventional art in reference to FIG. 21 and FIG. 22. As operation of the thermal-transfer printer 100 according to other example of the conventional art, first, by rotating the first carrying roller 170 and the second carrying roller 180 in an arrow mark A direction of FIG. 21, the record sheet 200 is carried to between the attaching roller 120 and the thermal head 131 of the heating portion 130. When the carried record sheet 200 comes to a printing start position, by the drive force transmitted from the power transmitting portion 150 (refer to FIG. 12), the pressing member 140 is pivoted in an arrow mark C direction of FIG. 21. Further, by pivoting the pressing member 140 in the arrow mark C direction of FIG. 21, the boss portions 133*a* of the pair of head supporting arms 133 of the heating portion 130 are respectively pressed down by the first pressing arm 141 and the second pressing arm 142 of the pressing member 140 (refer to FIG. 12). Thereby, the heating portion 130 is pivoted in an arrow mark F direction by constituting a fulcrum by the supporting shaft 111. Thereby, as shown by FIG. 22, the thermal head 131 heated to predetermined temperature presses the platen roller 120 to pinch the ink sheet 161 of the ink cartridge 160 and the record sheet 200 and therefore, thermally melting ink coated on an ink sheet 161 of the ink cartridge 160 is melted to transfer an image onto the record sheet 200. Thereafter, in accordance with pivoting the pressing member 140 in an arrow mark D direction of FIG. 22, the heating portion 130 urged by the torsional coil spring 111*a* (refer to FIG. 12) is pivoted in an arrow mark E direction of FIG. 22. Thereby, the pressing force of the thermal head 131 of the heating portion 130 to the platen roller 120 is released. Further, by rotating the first carrying roller 170 and the second carrying roller 180 in an arrow mark B direction of FIG. 22, the record sheet 200 transferred with the image is carried to a discharge side.

However, according to the thermal-transfer printer 100 shown in FIG. 12, the oval shape portions 143*a* and 143*c* provided on both sides of the connecting member 143 for connecting the first pressing arm 141 and the second pressing arm 142 are formed by cutting which takes time in working and therefore, there poses a problem that a number of steps of working the connecting members 143 is increased and fabrication cost is increased.

Further, in the thermal-transfer printer 100 shown in FIG. 12, a torque is transmitted from the second pressing arm 142 to the first pressing arm 141 by the oval shape portions 143*a* and the 143*c* of the connecting member 143 and therefore, when a larger torque is going to be transmitted from the second pressing arm 142 to the first pressing arm 141, an excessive force is exerted to the fitting portion 141*a* and the fitting portion 142*a* of the first pressing arm 141 the second pressing arm 142. Therefore, there also poses a problem that the fitting portion 141*a* and the fitting portion 142*a* are liable to be deformed and the first pressing arm 141 and the second pressing arm 142 are liable to be destructed.

Further, in JP-A-11-058878 and JP-A-5-085012, mentioned above, a structure of pressing to pivot a member for supporting the thermal head to a side of the platen roller is not disclosed and therefore, it seems that a structure per se constituting a premise of the invention is not disclosed. Further, also according to the thermal printer disclosed in JP-A-2001-353923, mentioned above, a structure of attaching the worm wheel and the pivoted shaft member is not disclosed and therefore, similar to JP-A-11-058878 and JP-A-5-085012, mentioned above, it seems that a structure per se constituting the premise of the invention is not disclosed.

SUMMARY OF THE INVENTION

The invention has been carried out in order to resolve the above-described problem and it is an object of the invention to provide a thermal-transfer printer capable of reducing time of working a member for pivoting a member for supporting a thermal head to a side of a platen roller and capable of transmitting a torque without destructing the member.

According to a first aspect of the invention, there is provided a thermal-transfer printer including: a main body frame; a platen roller that conveys a sheet; a thermal head that thermally transfers ink from an ink sheet onto the sheet and disposed where opposes to the platen roller; a pair of head supporting members each including a boss portion and disposed to be pivotable around a predetermined fulcrum, the pair of head supporting members being provided to support the thermal head; and a pressing member that pivots the pair of head supporting members to a side of the platen roller by respectively pressing the boss portion of the pair of head supporting members with driving force provided by a drive gear, the pressing member including: a first pressing arm and a second pressing arm that respectively press the pair of head supporting members, at least one of the first and the second pressing arms having a gear engaging portion to which the drive gear is engaged; and a connecting member connecting the first pressing arm and the second pressing arm and including a first bending portion and a second bending portion formed by bending both end portions of the connecting member in a L-lettered shape, the first bending portion and the second bending portion each having: a supporting shaft portion fitted to the main body frame for pivotably supporting the first pressing arm and the second pressing arm; and a recess portion in which the first bending portion and the second bending portion are respectively fitted, wherein the first pressing arm further includes: a first notch portion provided at a vicinity of the recess portion at which a front end portion of the first bending portion is disposed, the first notch portion that enables to fit the first bending portion to the recess portion from a direction intersecting with a center line of pivoting the first pressing arm; and a drawout preventing portion that prevents the first bending portion from being detached from the first notch portion, and wherein the second pressing arm further includes a second notch portion provided at a vicinity of the recess portion at which a base end portion of the second bending portion is disposed, the second notch portion that enables to fit the second bending portion to the recess portion from a direction intersecting with a center line of pivoting the second pressing arm and the direction opposes to the direction of fitting the first bending portion, the second notch portion being provided at a position where abuts to a portion at which the base end portion of the second bending portion is disposed.

According to a second aspect of the invention, there is provided a thermal-transfer printer including: a platen roller that conveys a sheet; a thermal head that thermally transfers ink from an ink sheet onto the sheet and disposed where opposes to the platen roller; a pair of head supporting members disposed to be pivotable around a predetermined fulcrum and supports the thermal head; and a pressing member that pivots the pair of head supporting members to a side of the platen roller by respectively pressing the pair of head supporting members, the pressing member including: a first pressing arm and a second pressing arm that respectively press the pair of head supporting members; and a connecting member connecting the first pressing arm and the second pressing arm and including a first bending portion and a second bending portion formed by bending both end portions of the connecting member, the first bending portion and the second bending portion each having a recess portion in which the first bending portion and the second bending portion are respectively fitted.

BRIEF DESCRIPTION OF THE DRAWINGS

The above objects and advantages of the present invention will become more apparent by describing preferred exemplary embodiments thereof in detail with reference to the accompanying drawings, wherein.

DETAILED DESCRIPTION OF THE PREFERRED EMBODIMENTS

Referring now to the accompanying drawings, a description will be given in detail of a preferred embodiment of the invention.

Figure 1:
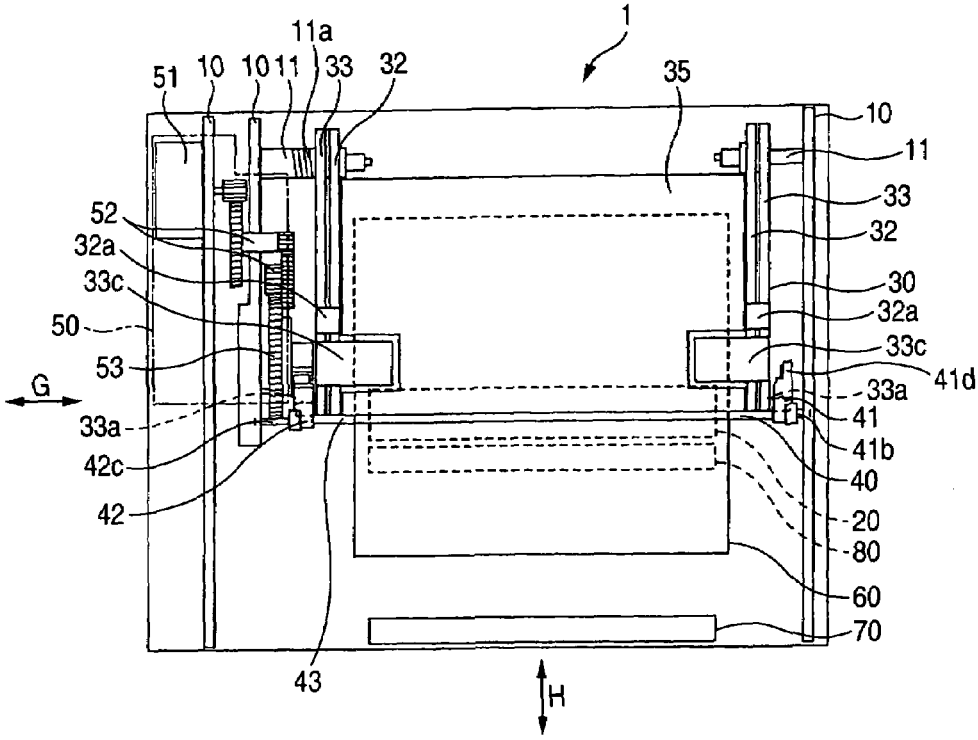
FIG. 1 is a top view showing a thermal-transfer printer according to an embodiment of the invention.
Figure 2:
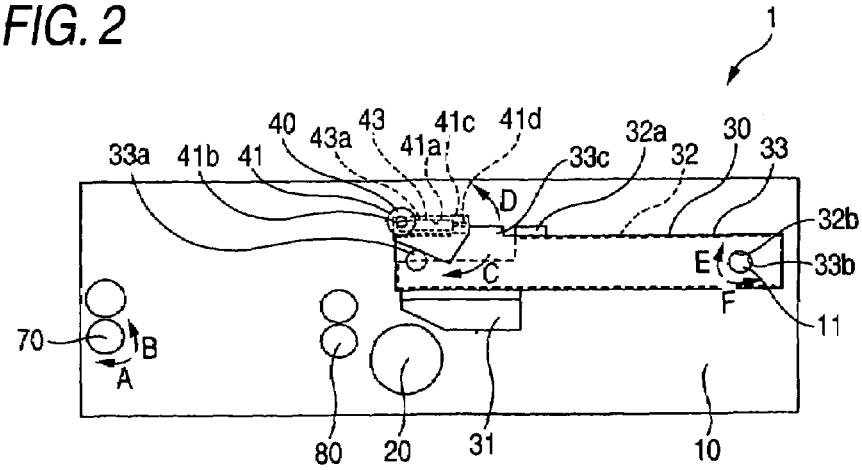
FIG. 2 is a side sectional view of the thermal-transfer printer according to the embodiment of the invention shown in FIG. 1.
Figure 3:
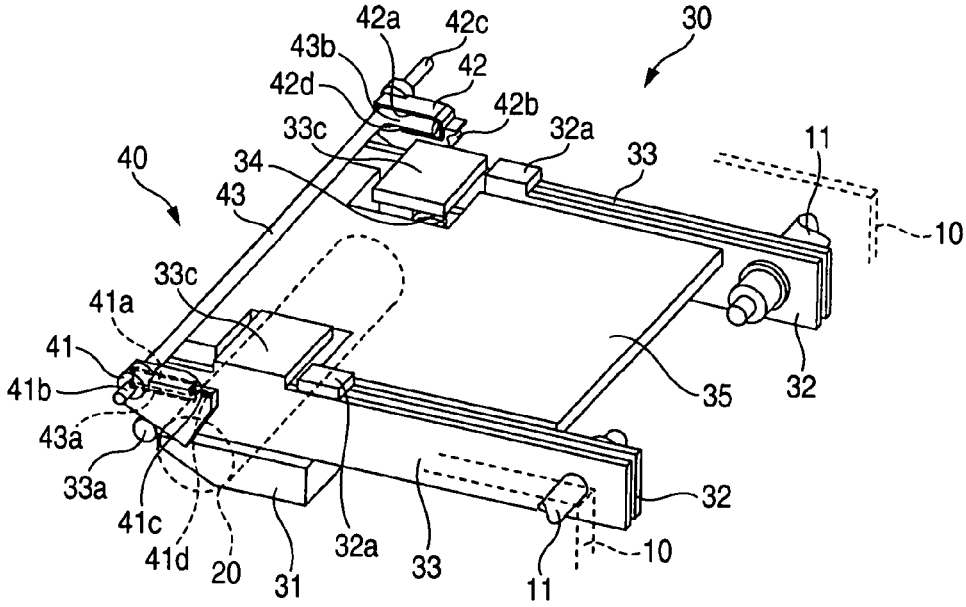
FIG. 3 is a perspective view showing a heating portion and a pressing member of the thermal-transfer printer according to the embodiment of the invention shown in FIG. 1.
Figure 4:
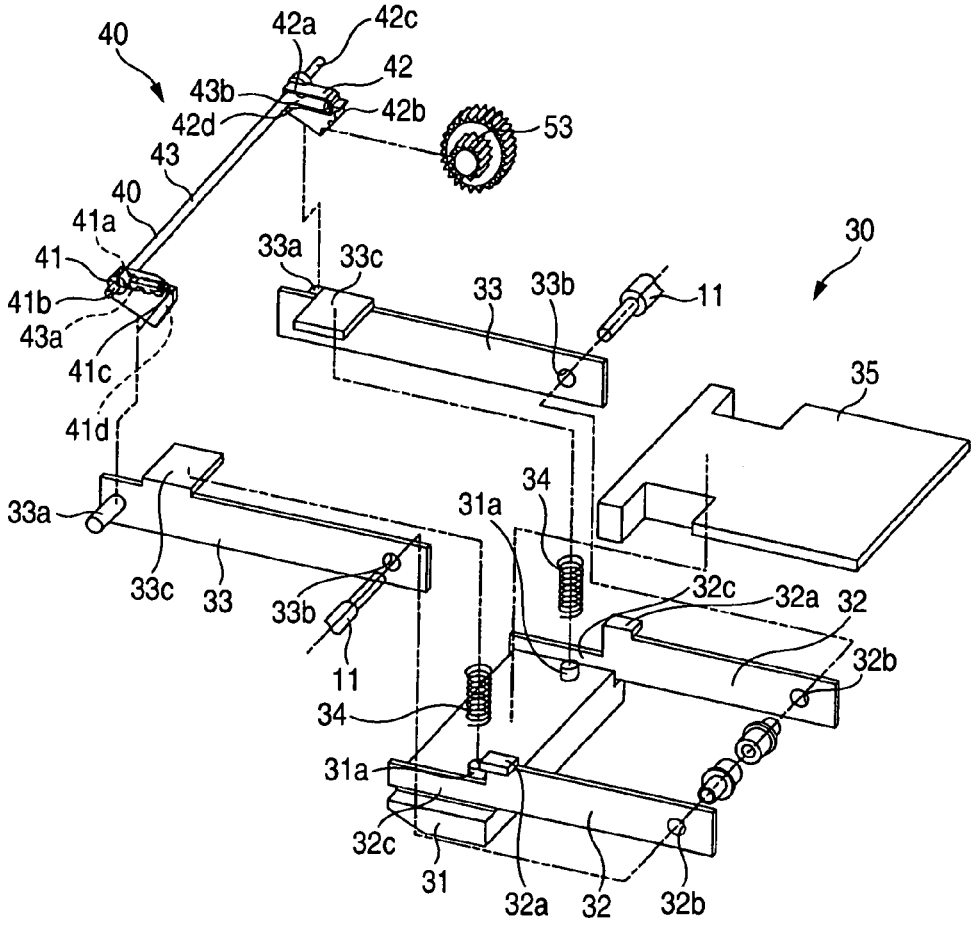
FIG. 4 is a disassembled perspective view of the heating portion and the pressing member of the thermal-transfer printer according to the embodiment of the invention shown in FIG. 3.

FIG. 1 is a top view showing a thermal-transfer printer according to an embodiment of the invention. FIG. 2 is a side sectional view of the thermal-transfer printer according to the embodiment of the invention shown in FIG. 1. FIG. 3 is a perspective view showing a heating portion and a pressing member of the thermal-transfer printer according to the embodiment of the invention shown in FIG. 1. FIG. 4 is a disassembled perspective view of the heating portion and the pressing member of the thermal-transfer printer according to the embodiment of the invention shown in FIG. 3. FIG. 5 through FIG. 9 are perspective views for explaining details of the pressing member and the connecting member of the thermal-transfer printer according to the embodiment of the invention shown in FIG. 1. First, an explanation will be given of a structure of the thermal-transfer printer 1 according to the embodiment in reference to FIG. 1 through FIG. 9.

As shown by FIG. 1 and FIG. 2, the thermal-transfer printer 1 according to the embodiment includes a main body frame 10, a platen roller 20, a heating portion 30, a pressing member 40, a power transmitting portion 50, an ink cartridge 60, a first carrying roller 70 and a second carrying roller 80. Further, the power transmitting portion 50 includes a motor 51, two middle gears 52, and a drive gear 53. The motor 51 transmits a drive force to the drive gear 53 via the two middle gears 52.

The main body frame 10 is provided with two supporting shafts 11 for pivotably supporting two side faces of the heating portion 30 opposed to each other. A torsional coil spring 11*a* is mounted to one side of the two supporting shafts 11. A torsional coil spring 11*a* is mounted to urge to pivot the heating portion 30 in an arrow mark E direction of FIG. 2. Further, as shown by FIG. 2, the heating portion 30 is configured to be able to pivot in the arrow mark E direction or in an arrow mark F direction and press the platen roller 20 by a predetermined pressing force. As shown by FIG. 2 through FIG. 4, the heating portion 30 includes a thermal head 31, a pair of head attaching arms 32, a pair of head supporting arms 33, two compression coil springs 34, and a heat radiating member 35. Further, the pair of head attaching arms 32 and the pair of head supporting arms 33 are an example of "head supporting members" of the invention.

The thermal head 31 is provided with a function of generating heat to predetermined temperature. Further, as shown by FIG. 4, two spring attaching boss portion 31*a* are provided at an upper face of the thermal head 31. Further, the pair of head attaching arms 32 include arm pressing portions 32*a*, fitting hole portions 32*b* and head attaching portions 32*c*. The arm pressing portion 32*a* is provided for restraining movement of the head supporting arm 33 urged to pivot in the arrow mark E direction of FIG. 2 relative to the thermal head 31. The fitting hole portion 32*b* is fit to the supporting shaft 11 of the main body frame 10. Further, the head attaching portion 32*c* is attached with the thermal head 31.

Further, the pair of head supporting arms 33 is provided to pinch the pair of head attaching arms 32 attached with the thermal head 31 from outer sides. The head supporting arm 33 includes a boss portion 33*a*, a fitting hole portion 33*b*, and a spring pressing portion 33*c*. The boss portion 33*a* is provided to project to an outer side at a side face at a vicinity of one end portion of the head supporting arm 33. Further, the fitting hole portion 33*b* is provided at a vicinity of other end portion of the head supporting arm. The fitting hole portion 33*b* is fit with the supporting shaft 11 of the main body frame 10. Further, the spring pressing portion 33*c* is provided to project from an upper portion of the head supporting arm 33 to an inner side.

Further, the two compression coil springs 34 are respectively fit to between the two spring attaching boss portions 31*a* of the thermal head 31 and the spring pressing portion 33*c* of the pair of head supporting arms 33. Thereby, the thermal head 31 is brought into a state of being supported by the head supporting arm 33 via the compression coil spring 34. Further, the heat radiating member 35 is arranged above an upper face of the thermal head 31 and is provided with a function for radiating heat of the thermal head 31.

Further, as shown by FIG. 1 through FIG. 4, the pressing member 40 is configured to be able to pivot the heating portion 30 in the arrow mark F direction of FIG. 2 by pressing down the boss portions 33*a* respectively provided to the pair of head supporting arms 33 of the heating portion 30. Further, the pressing member 40 includes a first pressing arm 41, a second pressing arm 42 and a connecting arm member 43. Further, the connecting member 43 is provided for connecting the first pressing arm and the second pressing arm. The connecting arm 43 is formed by a rod member made of a metal.

Figure 5:
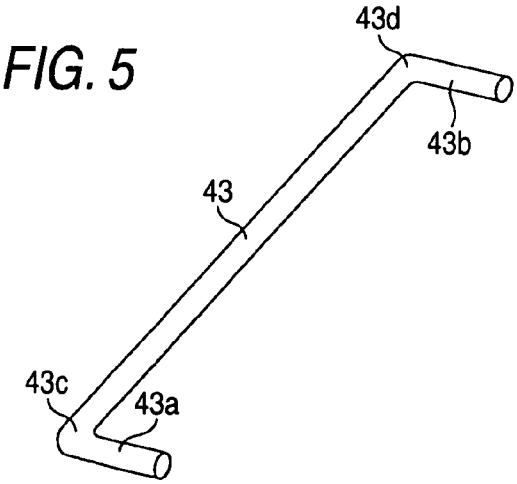
FIG. 5 is a perspective view showing a connecting member of the pressing member of the thermal-transfer printer according to the embodiment of the invention shown in FIG. 1.

Here, according to the embodiment, as shown by FIG. 5, both ends of the connecting member 43 are respectively formed with a first bending portion 43*a* and a second bending portion 43*b*. The first bending portion 43*a* and the second bending portion 43*b* are respectively formed by constituting base end portions 43*c* and 43*d* by positions remote from end portions of a rod member made of a metal by predetermined distances and folding to bend the end portions of the rod member made of a metal in an L-lettered shape.

Figure 6:
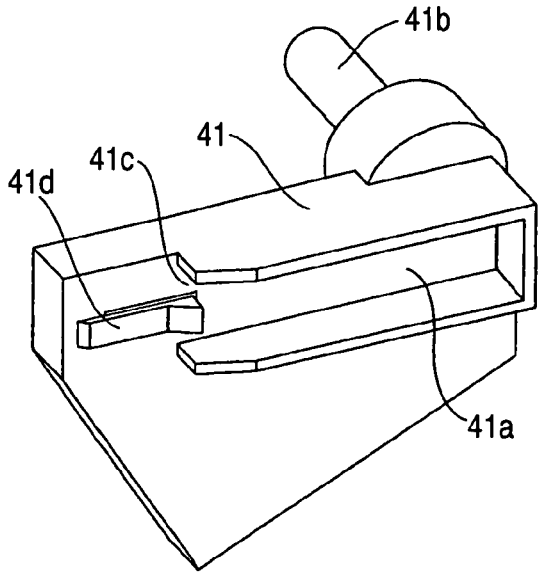
FIG. 6 is a perspective view showing a first pressing arm of the pressing member of the thermal-transfer printer according to the embodiment of the invention shown in FIG. 1.
Figure 7:
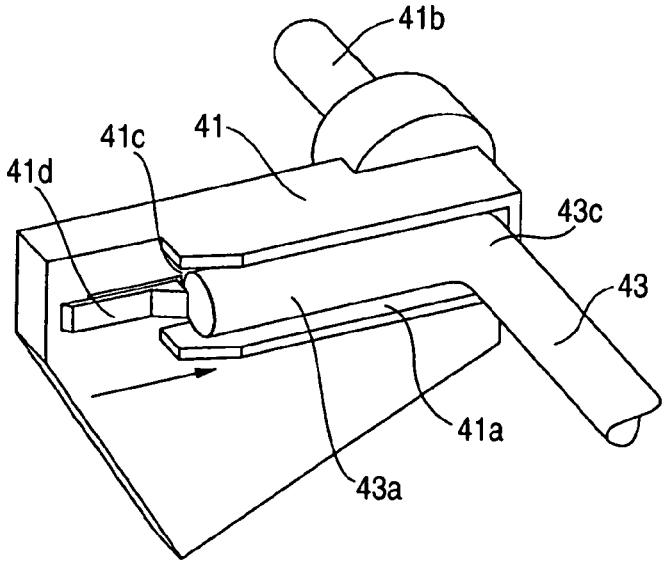
FIG. 7 is a perspective view showing a state of fitting the connecting member to the first pressing arm shown in FIG. 6.

Further, according to the embodiment, as shown by FIG. 6, the first pressing arm 41 is formed by a resin material and includes a recess portion 41*a*, a supporting shaft portion 41*b*, a first notch portion 41*c*, and a drawout preventing portion 41*d*. The recess portion 41*a* is provided on a side at which the first pressing arm 41 and the second pressing arm 42 are opposed to each other. As shown by FIG. 7, the recess portion 41*a* is fit with the first bending portion 43*a* in the L-lettered shape of the connecting member 43. Further, the supporting shaft portion 41*b* of the first pressing arm 41 is provided on a side opposed to the recess portion 41*a*. As shown by FIG. 1, the supporting shaft portion 41*b* is fit to the main body frame 10. Thereby, the pressing member 40 is pivotably supported. Further, when the connecting member 43 is fit to the recess portion 41*a* of the first pressing arm 41 as shown by FIG. 7, the first notch portion 41*c* is provided at a portion at which a front end of the first bending portion 43*a* in the L-lettered shape of the connecting member 43 is disposed. The first notch portion 41*c* is provided for enabling to fit the first bending portion 43*a* in the L-lettered shape of the connecting member 43 to the recess portion 41*a* from a direction (arrow mark direction in FIG. 7) intersecting with the center line of pivoting the first pressing arm 41. Further, the drawout preventing portion 41*d* is provided with a function of holding the connecting member 43 fit to the recess portion 41*a* of the first pressing arm 41 such that the connecting member 43 is not detached from the first notch portion 41*c*.

Figure 8:
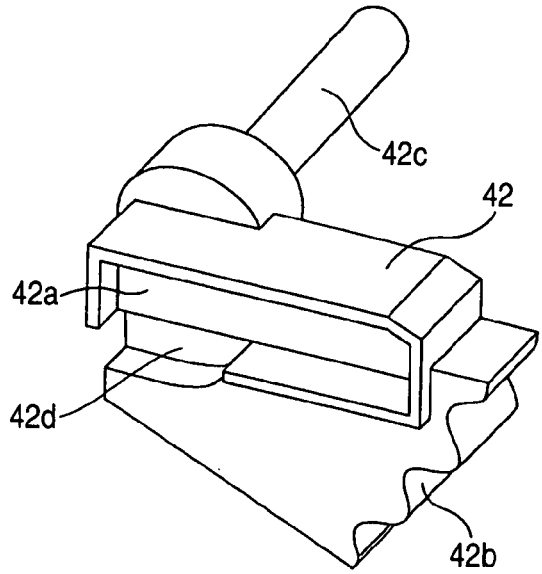
FIG. 8 is a perspective view showing a second pressing arm of the pressing member of the thermal-transfer printer according to the embodiment of the invention shown in FIG. 1.
Figure 9:
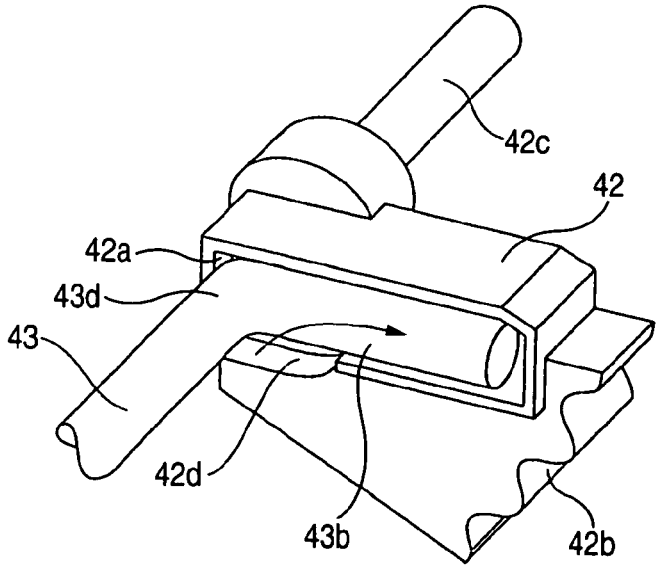
FIG. 9 is a perspective view showing a state of fitting a connecting member to the second pressing arm shown in FIG. 8.

Further, according to the embodiment, as shown by FIG. 8, the second pressing arm 42 is formed by a resin material and includes a recess portion 42*a*, a gear engaging portion 42*b*, a supporting shaft portion 42*c*, and a second notch portion 42*d*. The recess portion 42*a* is provided on a side at which the first pressing arm 41 and the second pressing arm 42 are opposed to each other. As shown by FIG. 9, the recess portion 42*a* is fit with the second bending portion 43*b* in the L-lettered shape of the connecting member 43. Further, as shown by FIG. 1, the gear engaging portion 42*b* is arranged to engage with the drive gear 53 of the power transmitting portion 50. Further, the supporting shaft portion 42*c* is provided on a side opposed to the recess portion 42*a*. The supporting shaft portion 42*c* is fit to the main body frame 10. Thereby, the pressing member 40 is pivotably supported. Further, when the connecting member 43 is fit to the recess portion 42*a* of the second pressing arm 42 as shown by FIG. 9, the second notch portion 40*d* is provided to be contiguous to the base end portion 43*d* of the second bending portion 43*b* in the L-lettered shape of the connecting member 43. The second notch portion 42*d* is provided for enabling to fit the second bending portion 43*b* in the L-lettered shape of the connecting member 43 to the recess portion 42*a* from a direction of intersecting with a center line of pivoting the second fitting arm 42 and a direction (arrow mark direction in FIG. 9) opposed to the direction of the fitting the first bending portion 43*a*. Specifically, after inserting a front end portion of the second bending portion 43*b* in the L-lettered shape to the second notch portion 42*d* from a skewed direction, and after completely fitting the second bending portion 43*b* in the L-lettered shape to the recess portion 42*a*, the base end portion 43*d* of the second bending portion 43*b* in the L-lettered shape is held by a portion of the recess portion 42*a* disposed at the base end portion 43*d* of the second bending portion 43*b*. Thereby, the base end portion 43*d* of the second bending portion 43*b* in the L-lettered shape can be prevented from being drawn out.

Figure 10:
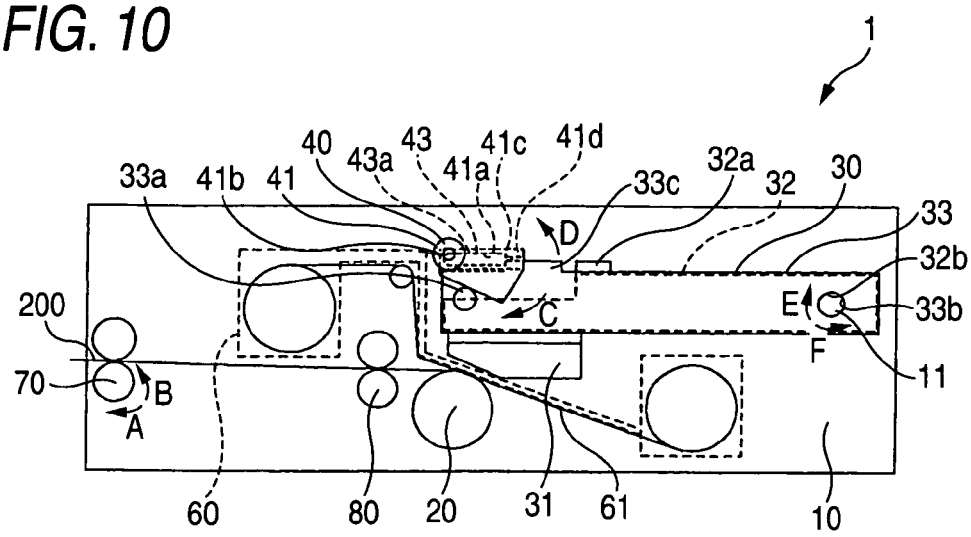
FIG. 10 is a side sectional view for explaining an operation of the thermal-transfer printer according to the embodiment of the invention.
Figure 11:
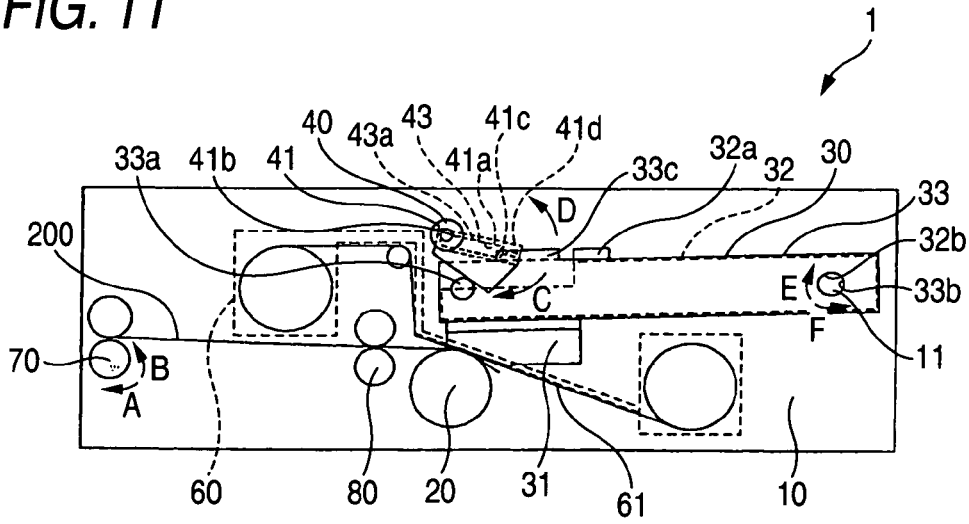
FIG. 11 is a side sectional view showing a state of bringing a thermal head into contact with a side of a platen roller in the thermal-transfer printer according to the embodiment of the invention shown in FIG. 10.
Figure 12:
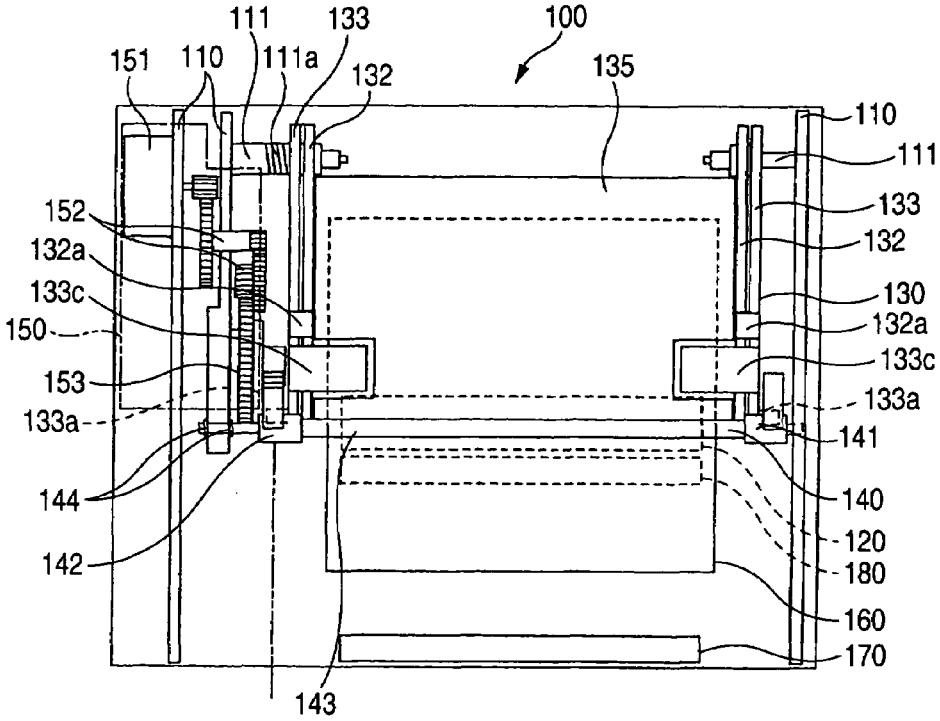
FIG. 12 is a top view showing a thermal-transfer printer according to an example of a conventional art.
Figure 13:
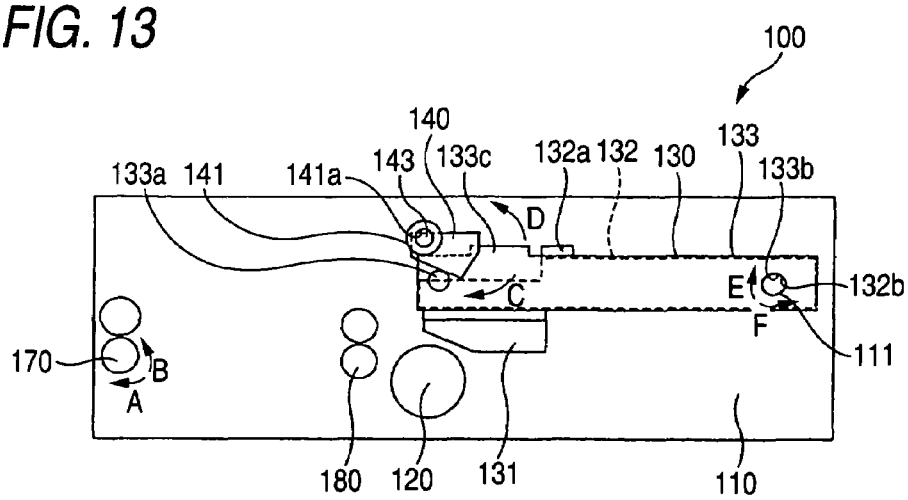
FIG. 13 is a side sectional view of the thermal-transfer printer according to the example of the conventional art shown in FIG. 12.
Figure 14:
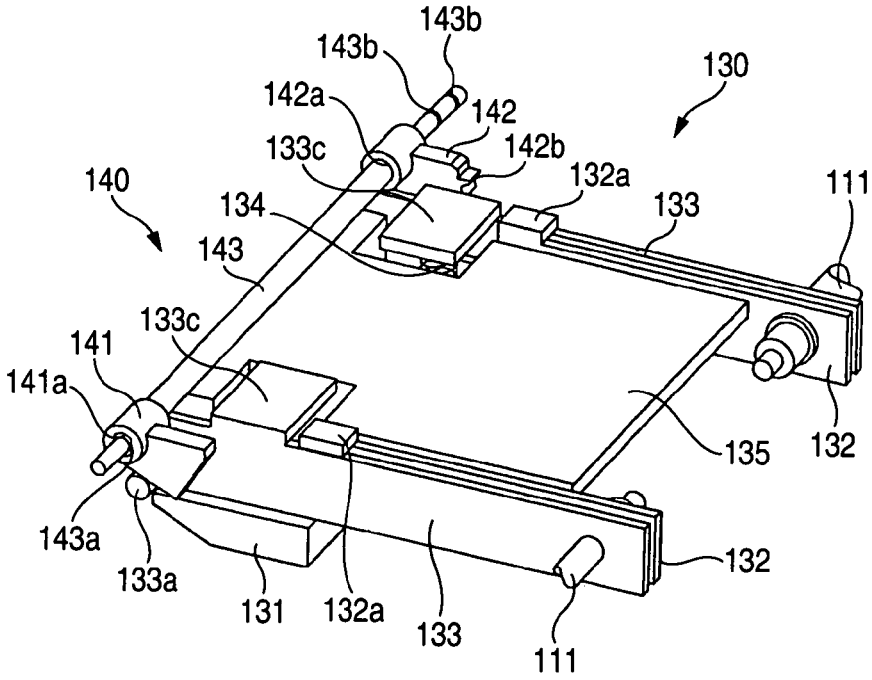
FIG. 14 is a perspective view showing a heating portion and a pressing member of the thermal-transfer printer according to the example of the conventional art shown in FIG. 12.
Figure 15:
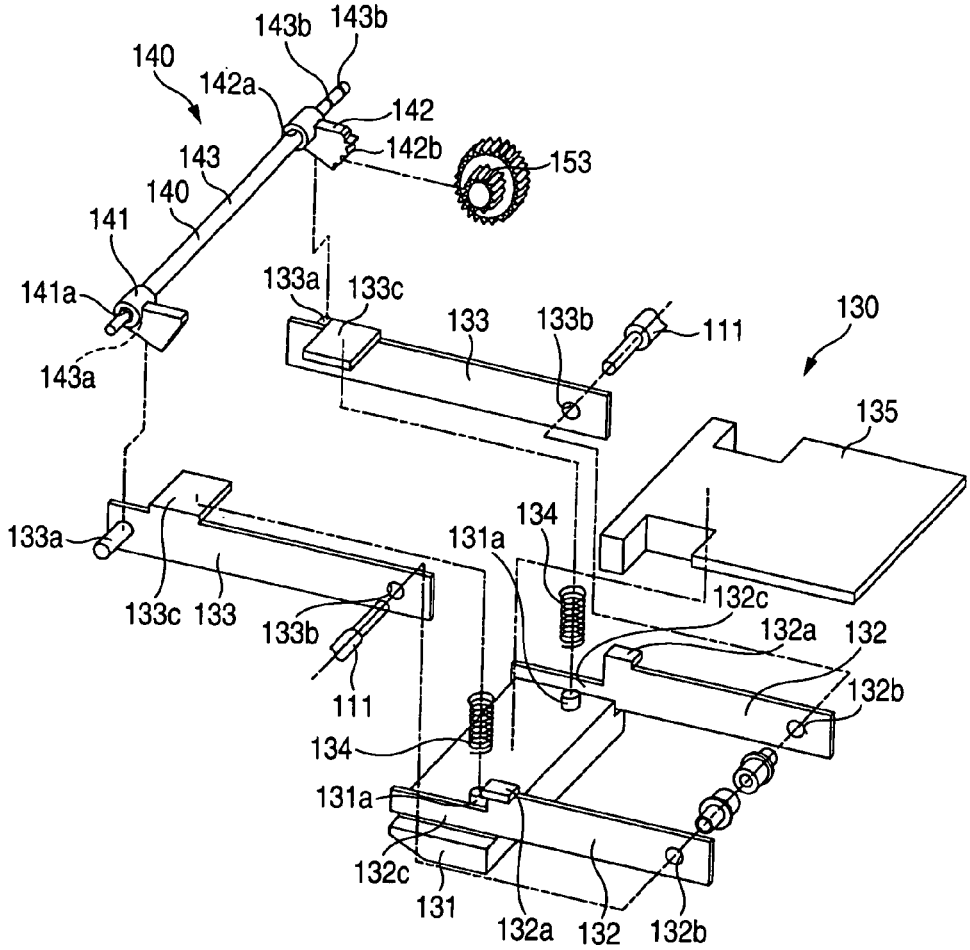
FIG. 15 is a disassembled perspective view of the heating portion and the pressing member of the thermal-transfer printer according to the example of the conventional art shown in FIG. 14.
Figure 16:
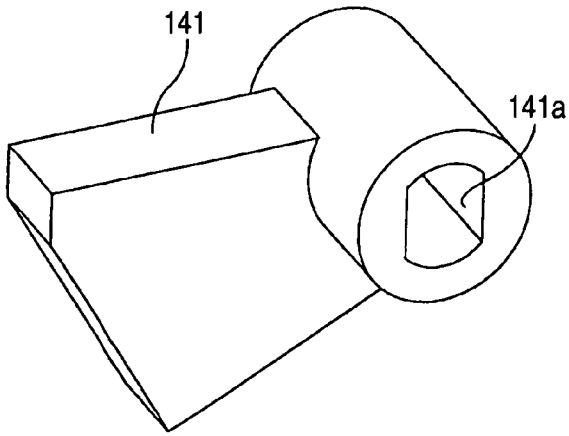
FIG. 16 is a perspective view showing a first pressing arm of the pressing member of the thermal-transfer printer according to the example of the conventional art shown in FIG. 12.
Figure 17:
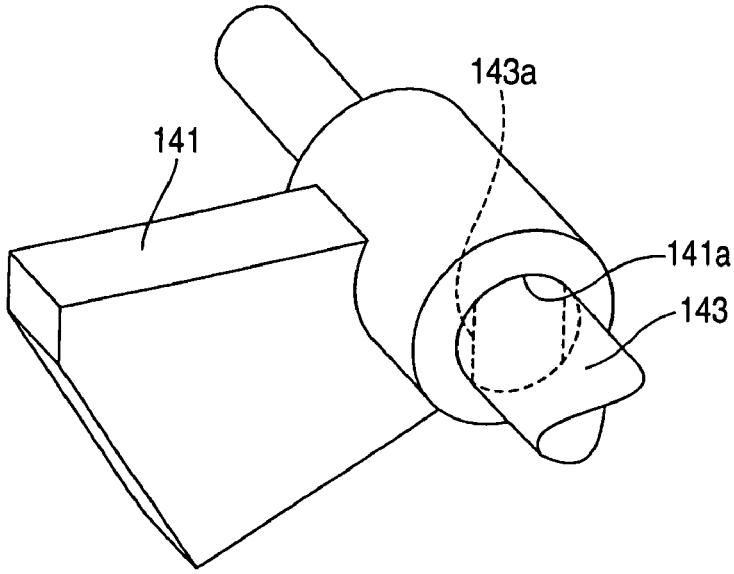
FIG. 17 is a perspective view showing a state of fitting a connecting member to the first pressing arm shown in FIG. 16.
Figure 18:
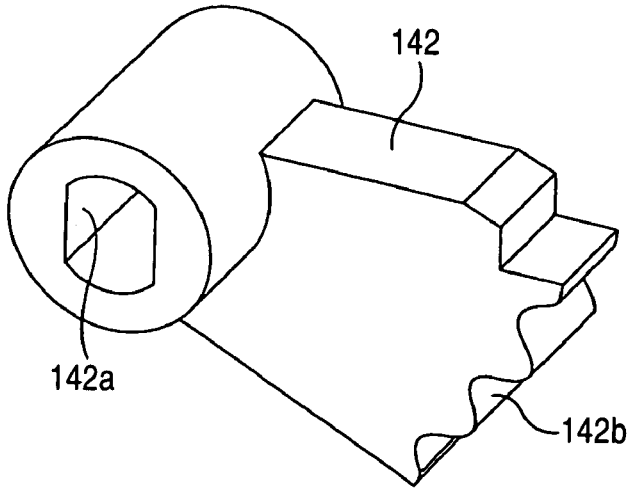
FIG. 18 is a perspective view showing a second pressing arm of the pressing member of the thermal-transfer printer according to the example of the conventional art shown in FIG. 12.
Figure 19:
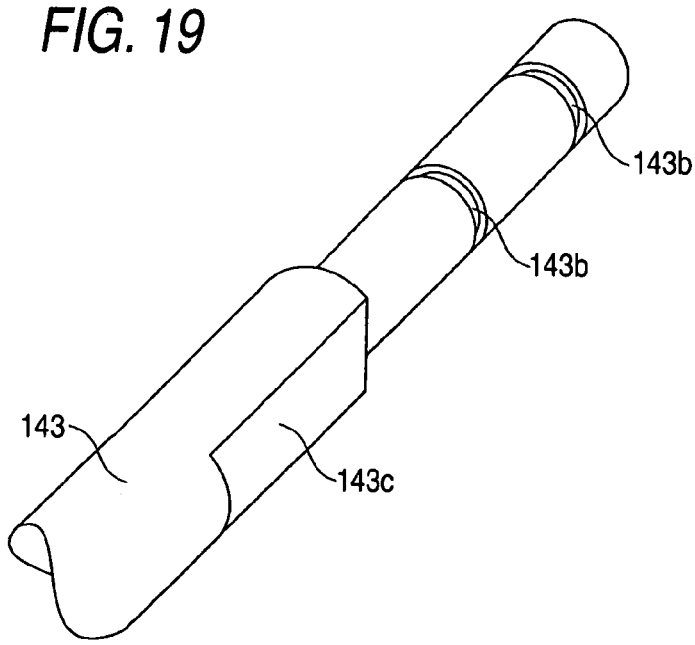
FIG. 19 is a perspective view showing an end portion of the connecting member fit to the second pressing arm shown in FIG. 18.
Figure 20:
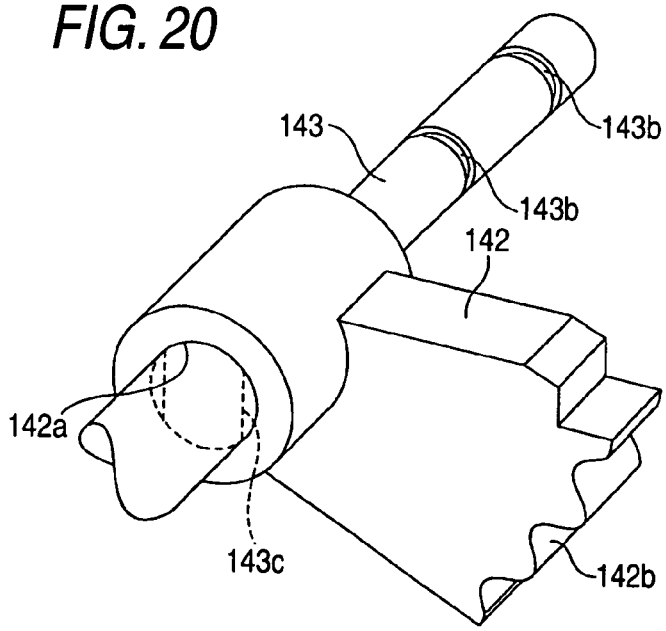
FIG. 20 is a perspective view showing a state of fitting the connecting member to the second pressing arm shown in FIG. 18.
Figure 21:
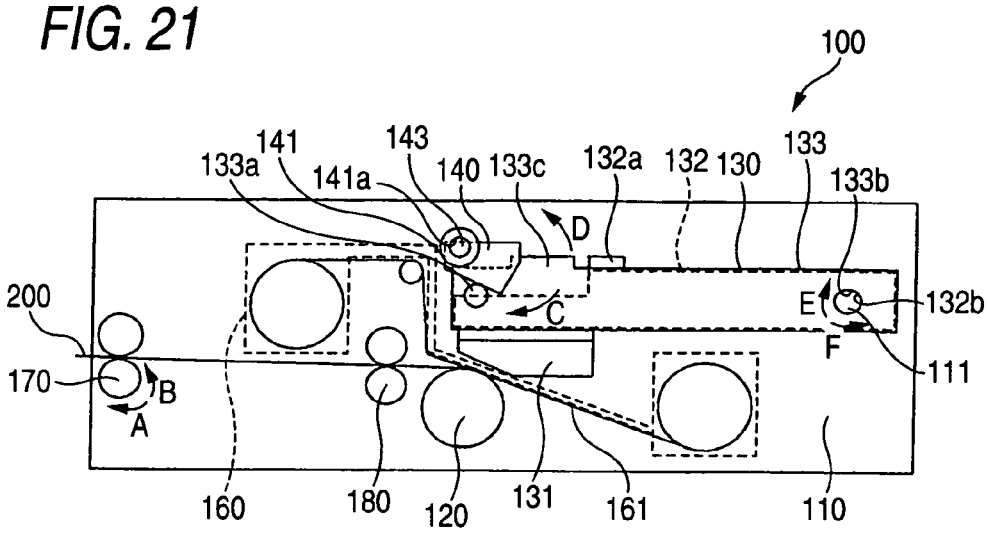
FIG. 21 is a side sectional view for explaining operation of the thermal-transfer printer according to the example of the conventional art.
Figure 22:
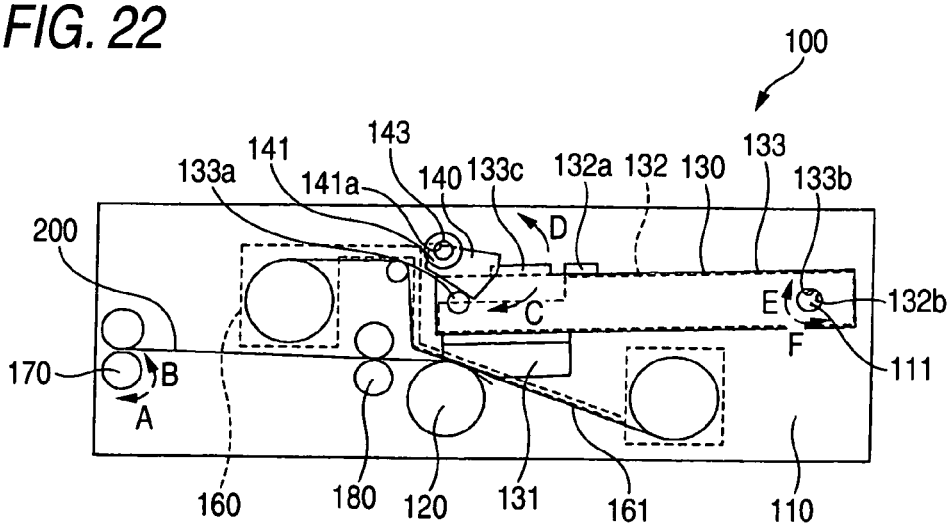
FIG. 22 is a side sectional view showing a state of bringing a thermal head into contact with a side of a platen roller in the thermal-transfer printer according to the example of the conventional art shown in FIG. 21.

FIG. 10 and FIG. 11 are side sectional views for explaining operation of the thermal-transfer printer according to the embodiment of the invention. Next, an explanation will be given of operation of the thermal-transfer printer 1 according to the embodiment in reference to FIG. 10 and FIG. 11. As operation of the thermal-transfer printer according to the embodiment, first, by rotating the first carrying roller 70 and the second carrying roller 80 in an arrow mark A direction of FIG. 10, the record sheet 200 is carried to between the platen roller 20 and the thermal head 31 of the heating portion 30. When the carried record sheet 200 comes to a printing start position, by the drive force transmitted from the power transmitting portion 50 (refer to FIG. 1), the pressing member 40 is pivoted in an arrow mark C direction of FIG. 10. Further, by pivoting the pressing member 40 in the arrow mark C direction of FIG. 10, the boss portions 33*a* of the pair of head supporting arms 33 of the heating portion 30 are respectively pressed down by the first pressing arm 41 and the second pressing arm 42 of the pressing member 40 (refer to FIG. 1). Thereby, the heating portion 30 is pivoted in an arrow mark F direction of FIG. 10 by constituting a fulcrum by the supporting shaft 11.

Thereby, as shown by FIG. 11, the thermal head 31 heated to predetermined temperature presses the platen roller 20 to pinch the ink sheet 61 of the ink cartridge 60 and the record sheet 200 and therefore, thermally melting ink coated on the ink sheet 61 of the ink cartridge 60 is melted and an image is transferred onto the record sheet 200. Thereafter, in accordance with pivoting the pressing member 140 in an arrow mark D direction of FIG. 11, the heating portion 30 urged by the torsional coil spring 11*a* (refer to FIG. 1) is pivoted in an arrow mark E direction of FIG. 11. Thereby, the pressing force of the thermal head 31 to the platen roller 20 is released. Further, by rotating the first carrying roller 70 and the second carrying roller 80 in an arrow mark B direction of FIG. 11, the record sheet 200 transferred with an image is carried to a discharge side.

According to the embodiment, as described above, by constituting the pressing member 40 for pressing the boss portion 33*a* of the head supporting arm 33 to include the connecting member 43 having the first bending portion 43*a* and the second bending portion 43*b* in the L-lettered shape at the both ends, and the first pressing arm 41 and the second pressing arm 42 having the recess portion 41*a* and the recess portion 42*b* fit with the first bending portion 43*a* and the second bending portion 43*b* in the L-lettered shape of the connecting member 43, when the head supporting arm 33 and the head supporting arm 32 are pivoted to the side of the platen roller 20 by pivoting the pressing member 40, a torque can be transmitted from the second pressing arm 42 to the first pressing arm 41 by the first bending portion 43*a* and the second bending portion 43*b* in the L-lettered shape of the connecting member 43. In this case, the first bending portion 43*a* and the second bending portion 43*b* in the L-lettered shape do not need cutting taking time in working and therefore, a number of steps of working the connecting member 43 of the pressing member 40 can be reduced by an amount of dispensing with cutting and fabrication cost can be reduced.

Further, according to the embodiment, the torque can be transmitted from the second pressing arm 42 to the first pressing arm 41 by a total of side face portions of the first bending portion 43*a* and the second bending portion 43*b* in the L-lettered shape of the connecting member 43 and therefore, in comparison with the case of the conventional art transmitting the torque by the portions in the oval shape, the torque can easily be transmitted without exerting excessive force to the portions of the first pressing arm 41 and the second pressing arm 42 fit with the connecting member 43. Thereby, the torque can be transmitted without destructing the first pressing arm 41 and the second pressing arm 42.

Further, according to the embodiment, by providing the first notch portion 41*c* and the second notch portion 42*d* for enabling to fit the first bending portion 43*a* and the second bending portion 43*b* in the L-lettered shape of the connecting member 43 to the recess portion 41*a* and the recess portion 42*a* of the first pressing arm 41 and the second pressing arm 42 from the direction intersecting with center lines of pivoting the first pressing arm 41 and the second pressing arm 42 respectively at the first pressing arm 41 and the second pressing arm 42, the connecting member 43 can be integrated to the first pressing arm 41 and the second pressing arm 42 from an arrow mark H direction of FIG. 1 and therefore, different from a case of integrating the connecting member 43 to the first pressing arm 41 and the second pressing arm 42 from an arrow mark G direction of FIG. 1, in integrating, the main body frame 10 does not constitute a hindrance. As a result, integration operability can be promoted.

Further, according to the embodiment, by providing the drawout preventing portion 41*d* for holding the first bending portion 43*a* in the L-lettered shape of the connecting member 43 such that the first bending portion 43*a* is not detached from the first notch portion 41*c* at the first pressing arm 41, after integrating the pressing member 40, the first bending portion 43*a* in the L-lettered shape can be prevented from being detached from the first notch portion 41*c* provided at the recess portion 41*a* of the first pressing arm 41.

Further, the embodiment disclosed at this time is only an exemplification in all the aspects and is not to be regarded as restrictive. A range of the invention is shown not by the above-described explanation of the embodiment but by the scope of claims and includes a significance equivalent to the scope of claims and all of changes within the range.

For example, although the above-described embodiment is configured to provide the second notch portion 42*d* at the second pressing arm 42 having the gear engaging portion 42*b* and provide the first notch portion 41*c* and drawout preventing portion 41*d* at the first pressing arm 41 which is not provided with the gear engaging portion, the invention is not limited thereto but may be configured to provide the first notch portion and the drawout preventing portion at the second pressing arm having the gear engaging portion and provide the second notch portion at the first pressing arm which is not provided with the gear engaging portion. Further, the notch portions may not be provided at the first and the second pressing arms.

In the embodiment described above, the first pressing arm 41 and the second pressing arm 42 are fitted into the recess portions 41*a*, 42*a* from opposite directions. However, the thermal-transfer printer according to the invention may be configured so as that both the first pressing arm 41 and the second pressing arm 42 are fitted into the recess portions 41*a*, 42*a* from the same directions. In this case, it is preferable to provide same type of notch portions (one of either of the notch portion 41*c* or the notch portion 42*d*) in the vicinity of both the recess portions 41*a*, 42*a*.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A thermal-transfer printer comprising:

a main body frame;

a platen roller that conveys a sheet;

a thermal head that thermally transfers ink from an ink sheet onto the sheet and disposed where opposes to the platen roller;

a pair of head supporting members each including a boss portion and disposed to be pivotable around a predetermined fulcrum, the pair of head supporting members being provided to support the thermal head; and a pressing member that pivots the pair of head supporting members to a side of the platen roller by respectively pressing the boss portion of the pair of head supporting members with driving force provided by a drive gear, the pressing member including:

a first pressing arm and a second pressing arm that respectively press the pair of head supporting members, at least one of the first and the second pressing arms having a gear engaging portion to which the drive gear is engaged; and a connecting member connecting the first pressing arm and the second pressing arm and including a first bending portion and a second bending portion formed by bending both end portions of the connecting member in a L-lettered shape, the first bending portion and the second bending portion each having: a supporting shaft portion fitted to the main body frame for pivotably supporting the first pressing arm and the second pressing arm; and a recess portion in which the first bending portion and the second bending portion are respectively fitted, wherein the first pressing arm further includes: a first notch portion provided at a vicinity of the recess portion at which a front end portion of the first bending portion is disposed, the first notch portion that enables to fit the first bending portion to the recess portion from a direction intersecting with a center line of pivoting the first pressing arm: and a drawout preventing portion that prevents the first bending portion from being detached from the first notch portion, and wherein the second pressing arm further includes a second notch portion provided at a vicinity of the recess portion at which a base end portion of the second bending portion is disposed, the second notch portion that enables to fit the second bending portion to the recess portion from a direction intersecting with a center line of pivoting the second pressing arm and the direction opposes to the direction of fitting the first bending portion, the second notch portion being provided at a position where abuts to a portion at which the base end portion of the second bending portion is disposed.

2. A thermal-transfer printer comprising:

a platen roller that conveys a sheet;

a thermal head that thermally transfers ink from an ink sheet onto the sheet and disposed where opposes to the platen roller;

a pair of head supporting members disposed to be pivotable around a predetermined fulcrum and supports the thermal head; and a pressing member that pivots the pair of head supporting members to a side of the platen roller by respectively pressing the pair of head supporting members, the pressing member including:

a first pressing arm and a second pressing arm that respectively press the pair of head supporting members; and a connecting member connecting the first pressing arm and the second pressing arm and including a first bending portion and a second bending portion formed by bending both end portions of the connecting member, the first bending portion and the second bending portion each having a recess portion in which the first bending portion and the second bending portion are respectively fitted.

3. The thermal-transfer printer according to claim 2, wherein the first pressing arm further includes a first notch portion provided at a vicinity of the recess portion at which a front end portion of the first bending portion is disposed, the first notch portion that enables to fit the first bending portion to the recess portion from a direction intersecting with a center line of pivoting the first pressing arm, and wherein the second pressing arm further includes a second notch portion provided at a vicinity of the recess portion at which a base end portion of the second bending portion is disposed, the second notch portion that enables to fit the second bending portion to the recess portion from a direction intersecting with a center line of pivoting the second pressing arm and the direction, opposes to the direction of fitting the first bending portion.

4. The thermal-transfer printer according to claim 3, wherein the second notch portion is provided at a position where abuts to a portion at which the base end portion of the second bending portion is disposed.

5. The thermal-transfer printer according to claim 3, wherein the first pressing arm further includes a drawout preventing portion that prevents the first bending portion from being detached from the first notch portion.

6. The thermal-transfer printer according to claim 2, wherein at least one of the first and the second pressing arms includes a notch portion provided at a vicinity of the recess portion, the notch portion that enables to fit the first or the second bending portion to the recess portion from a direction intersecting with a center line of pivoting the first or the second pressing arm.

* * * * *